US005857864A

United States Patent [19]

Fukuda

[11] Patent Number: 5,857,864

[45] Date of Patent: Jan. 12, 1999

[54] WATERPROOF CONNECTOR WITH GUIDE PORTION FOR ALIGNING CONNECTOR DURING ENGAGEMENT

[75] Inventor: Masaru Fukuda, Shizuoka, Japan

[73] Assignee: Yazaki Corporation, Tokyo, Japan

[21] Appl. No.: 807,689

[22] Filed: Feb. 28, 1997

[30] Foreign Application Priority Data

Feb. 28, 1996 [JP] Japan ..... 8-41679

[51] Int. Cl.[6] ..... H01R 13/52

[52] U.S. Cl. ..... 439/275; 439/587

[58] Field of Search ..... 439/275, 274, 439/279, 271, 587, 589, 523

[56] References Cited

U.S. PATENT DOCUMENTS

| | | | |
|---|---|---|---|
| 3,181,105 | 4/1965 | Roach et al. | 439/275 |
| 3,936,124 | 2/1976 | Tuttle et al. | 439/279 |
| 4,193,655 | 3/1980 | Herrmann, Jr. | 439/275 |

FOREIGN PATENT DOCUMENTS 4-101382 9/1992 Japan .

6-38171 5/1994 Japan .

*Primary Examiner*—Paula Bradley
*Assistant Examiner*—Tho Dac Ta
*Attorney, Agent, or Firm*—Sughrue, Mion, Zinn, Macpeak & Seas, PLLC

[57] ABSTRACT

A waterproof connector includes a terminal, a housing, a seal member, an inclined guide portion and a slide contact portion. The housing includes an insertion opening provided for receiving the terminal, a terminal lock portion provided inside the housing and a fixing lock portion provided outside the housing, both used for locking the terminal. The inclined guide portion is provided on either the housing or the fixing portion of the seal member, and the slide contact portion is provided on the other of the housing and the fixing portion so as to be slidable relative to the inclined guide portion. The inclined guide portion and the slide contact portion guide the seal member so that it rotates into a proper position and so that the fixing engagement portion engages with the fixing lock portion when the seal member is inserted into the insertion opening of the housing.

4 Claims, 4 Drawing Sheets

WATERPROOF CONNECTOR WITH GUIDE PORTION FOR ALIGNING CONNECTOR DURING ENGAGEMENT

BACKGROUND OF THE INVENTION

1. Field of the Invention

The present invention relates to a connector having a waterproof structure.

2. Description of the Related Art

Conventionally, as the connector of this type, there has been proposed such a connector as shown, for example, in FIG(S). 5, 6(*a*) and 6(*b*) (Japanese Utility Model Unexamined Publication No. Hei. 4-101382).

In this connector, a terminal 5 with a cable 3 clamped therein is received in a housing 1. The terminal 5 is inserted into the housing 1 from its insertion opening 7. A flexible lance 9 is provided in the inside of the housing 1 as a terminal lock portion for locking the terminal 5. Therefore, the terminal 5 is engaged with the flexible lance 9 so as to be locked. Lock pawls 11 are provided, as fixing lock portions, so as to project from an outer surface of an end portion of the insertion opening 7 of the housing 1. The insertion opening 7 of the housing 1 is sealed with a seal member 13 formed of an elastic body such as rubber so as to be waterproofed. The seal member 13 is tightly fitted onto the cable 3 at the terminal 5 side of the cable 3, and a front end (in FIG. 6(*a*)) of the seal member 13 is fixedly clamped with the cable 3 in a cable clamping portion 15 of the terminal 5. An outer peripheral surface of the seal member 13, on the other hand, is tightly fitted onto an inner peripheral surface of the insertion opening 7. A reinforcing portion 19 of an inserting member 17 is inserted into the inside of the seal member 13 (in FIG. 6 (*b*)) to increase the rigidity of the seal member 13. In the foregoing configuration, the waterproof function of the seal member 13 and the insertion workability of the seal member 13 into the insertion opening 7 are made improved. Lock engagement portions 21 are provided on the insertion member 17 so as to engage with the lock pawls 11. Consequently, the seal member 13 is accurately positioned by the engagement of the lock engagement portions 21 with the lock pawls 11 to thereby further improve the waterproof function.

In such a structure, however, the position of engagement of the flexible lance 9 with the terminal 5 and the position of engagement of the lock engagement portions 21 with the lock pawls 11 are determined univocally, while the insertion member 17 is assembled in the seal member 13 in advance and the seal member 13 with the insertion member 17 is fixedly clamped together with the cable 3 in the cable clamping portion 15 as shown in FIG. 5. Accordingly, the lock engagement portions 21 should be accurately positioned (particularly, in the direction of rotation) when the seal member 13 is clamped by the cable clamping potion 15, and there is a possibility that the assembling work of the seal member 13 in the terminal 5 becomes troublesome.

Further, there is a possibility that the lock engagement portions 21 are displaced in the rotational direction with respect to the terminal 5 so that it becomes difficult to attach the terminal 5, if the seal member 13 is clamped in the cable clamping portion 15 without performing accurate positioning.

SUMMARY OF THE INVENTION

An object of the present invention is to provide a connector in which a seal member can be attached easily and accurately.

In order to solve the foregoing problems, according to the present invention, there is provided a connector comprising: a terminal to which a cable is clamped; a housing including an insertion opening provided so as to receive the terminal inserted from the insertion opening, a terminal lock portion provided inside the housing for locking the inserted terminal, and a fixing lock portion provided outside the housing; a seal member including a seal portion made of an elastic material and a fixing portion which is harder than the seal portion, an inner surface of the seal portion being tightly fitted onto the cable so as to be rotatable relatively to the cable, an outer surface of the seal portion being tightly fitted onto an inner surface of the insertion opening upon insertion of the seal member into the insertion opening of the housing, and the fixing portion having a fixing engagement portion which is to be locked on the fixing lock portion; an inclined guide portion provided on one of the housing and the fixing portion of the seal member; and a slide contact portion provided on the other of the housing and the fixing portion so as to be slidable relatively to the inclined guide portion, wherein the inclined guide portion and the slide contact portion guide the seal member so as to make the seal member rotate into a position where the fixing engagement portion engages with the fixing lock portion when the seal member is to be attached into the insertion opening.

BRIEF DESCRIPTION OF THE DRAWINGS

FIG. 6(*b*) is an end elevational view showing the conventional example.

DETAILED DESCRIPTION OF THE PREFERRED EMBODIMENTS

Figure 1:
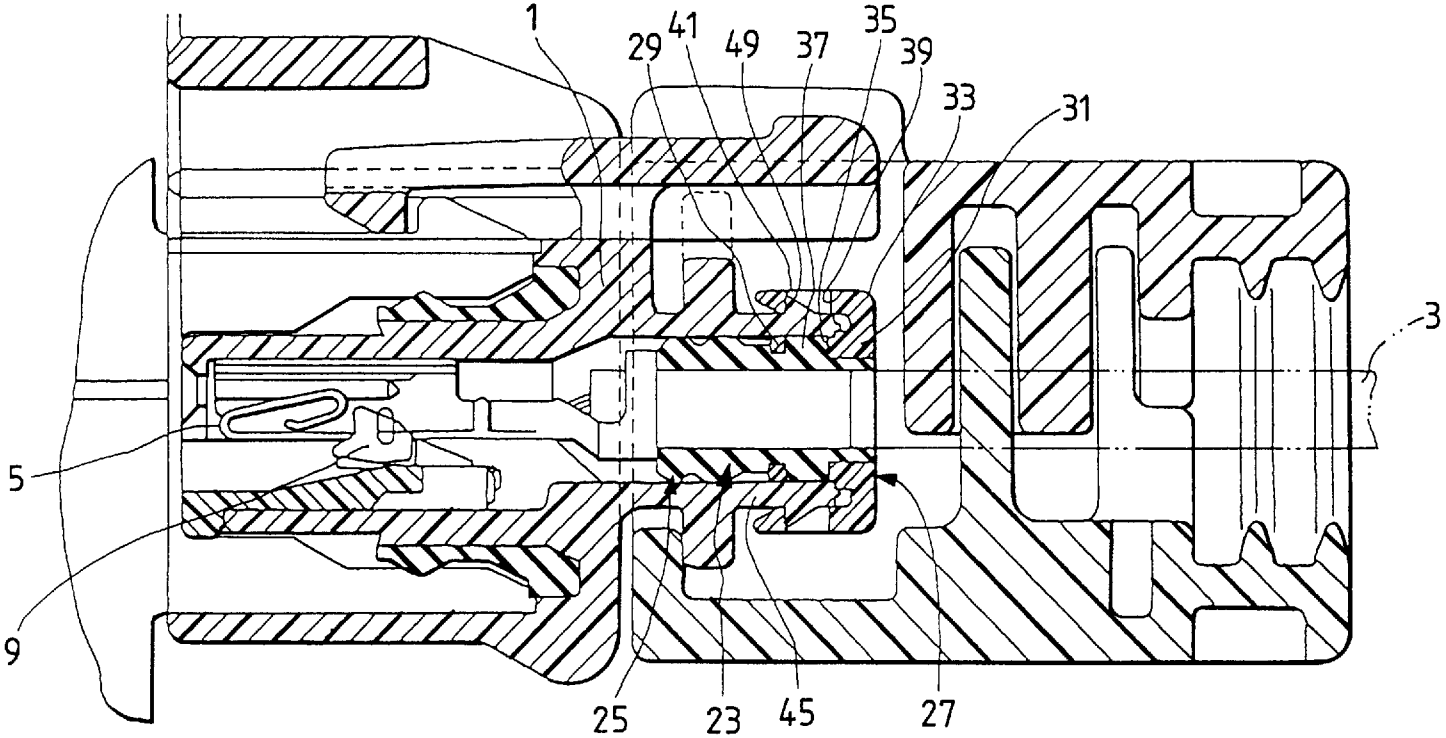
FIG. 1 is a sectional view of a connector according to an embodiment of the present invention.
Figure 2:
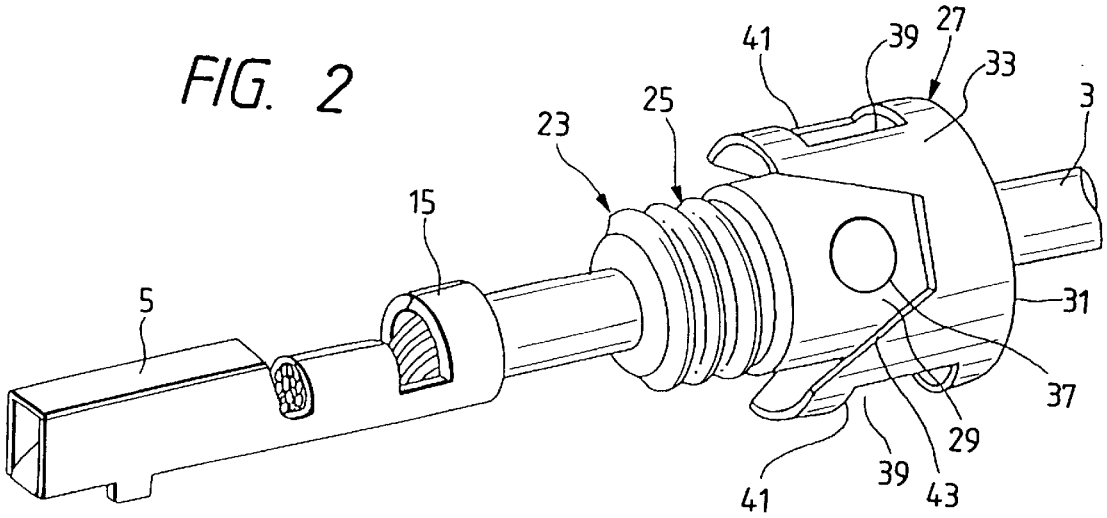
FIG. 2 is a perspective view showing a state where a seal member is fitted on a cable in the same embodiment of the present invention.

Embodiments of the present invention will be described below. FIG(S). 1 to 3 show a first embodiment of the connector according to the present invention. FIG. 1 is a sectional view showing the whole of the connector; FIG. 2 is a perspective view showing the main portion of the same; and FIG. 3 is a perspective view showing the main portion on the housing side. Further, in FIG(S). 1 to 3, portions corresponding to those of FIG(S). 5, 6(*a*) and 6(*b*) are correspondingly referenced and description about those portions is not made repeatedly.

In the first embodiment of the present invention, a seal member 23 is constituted by a seal portion 25 which is made of an elastic material such as rubber or the like, and a fixing portion 27 which is harder than the seal portion 25.

The inner surface of the seal portion 25 is tightly fitted onto a cable 3 and the outer surface of the seal portion 25 is tightly fitted onto the inner surface of an insertion opening 7 of a housing 1.

The fixing portion 27 is constituted by a reinforcing portion 29, a link portion 31, and a cylindrical portion 33.

The reinforcing portion 29 for reinforcing the seal portion 25 is formed into a cylindrical shape and has a size so as to be loosely fitted into the insertion opening 7. Connecting holes 35 are formed in the reinforcing portion 29 at predetermined circumferential intervals and connecting projections 37 formed on the seal portion 25 are fitted into the connecting holes 35 so that the reinforcing portion 29 is connected to the seal portion 25. The connecting projections 37 contact closely onto the inner surface of the insertion opening 7.

The cylindrical portion 33 is formed so as to cover the outside of the seal portion 25 as shown in FIG(S). 1 and 2. The cylindrical portion 33 is provided with, for example, two windows 39 which are formed so as to be radially opposite to each other to thereby form fixing engagement portions 41 on a front end of the cylindrical portion 33. Further, inclined guide portions 43 are formed on the cylindrical portion 33 so as to be inclined from the front end to the rear end of the cylindrical portion 33. That is, the inclined guide portions 43 start from the pair of fixing engagement portions 41, and gradually slope toward the link portion 31.

Figure 3A:
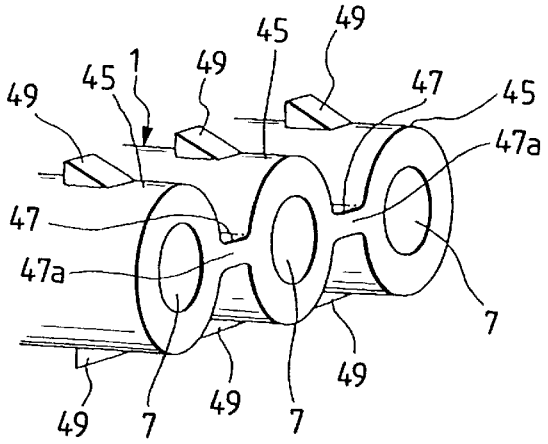
FIG. 3*a*is a perspective view showing a main portion of a housing in the same embodiment of the present invention.

The housing 1 is provided with multiple, for example triple, cylindrical cavity portions 45 as shown in FIG. 3*a*. Each of the cavity portions 45 has the above-mentioned insertion opening 7. The cavity portions 45 are connected integrally with each other through flat connecting portions 47. An end portion 47(*a*) of each of the connecting portions 47 is formed as a slide contact portion which slides relatively to the inclined guide portions 43. A pair of pawl-like fixing lock portions 49 are provided on the outside of each of the cavity portions 45 so as to lock the fixing engagement portions 41 as shown in FIG. 1.

In assembling, first, the seal member 23 is fitted onto the cable 3 so as to be attached thereon in advance as shown in FIG. 2. This attachment may be performed before or after the clamping of the cable 3 onto the terminal 5. Next, the terminal 5 assembled as shown in FIG. 2 is inserted into the insertion opening 7 of the housing 1 so as to be received and locked on a flexible lance 9. At this time, if the seal member 23 is pushed into under the condition that the fixing engagement portions 41 positionally correspond to the fixing lock portions 49, the seal portion 25 is tightly fitted as it is onto the inner surface of the insertion opening 7 so that the fixing engagement portions 41 of the cylindrical portion 33 are engaged with the fixing lock portions 49 of the housing 1 so as to be locked thereon.

Figure 3B:
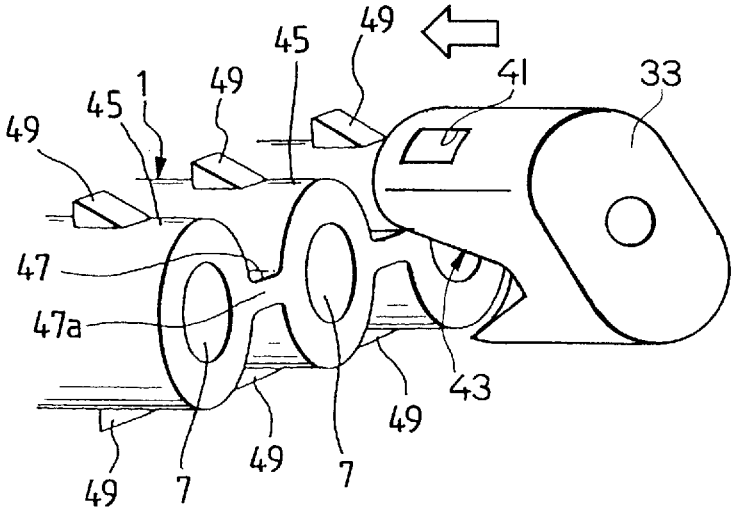
Figs. 3*b*and 3*c*are perspective views showing a state in which the seal member is obliquely inserted into the housing and turned into a normal position due to the inclined guide portions.
Figure 3C:
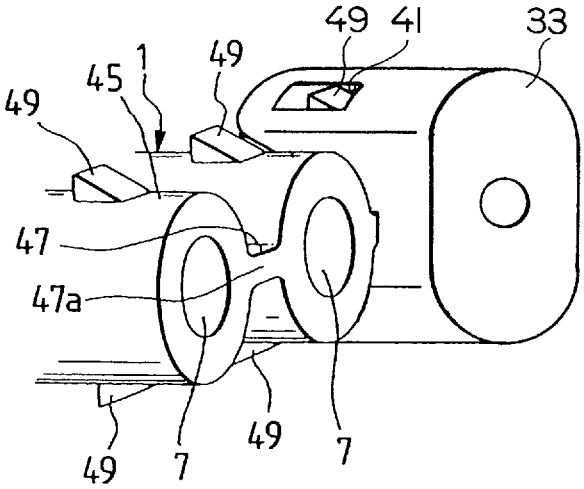
Figure 5:
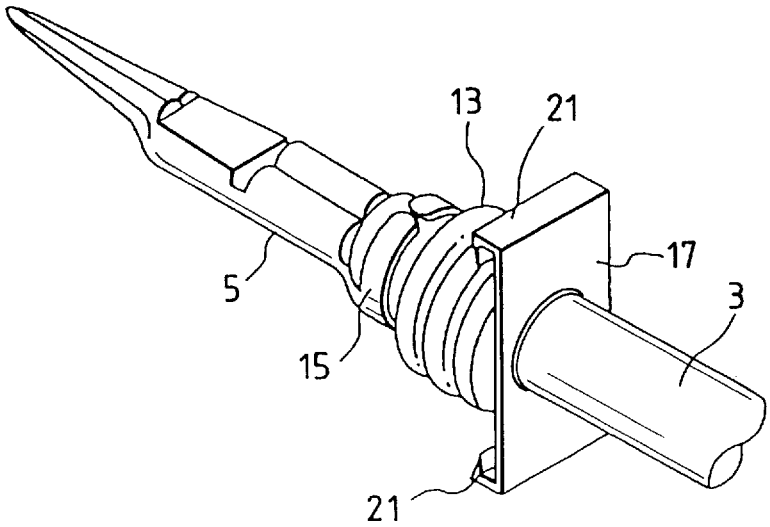
FIG. 5 PRIOR ART
FIG. 5 is a perspective view showing a state where a seal member is attached on a cable in a conventional example.
Figure 6A:
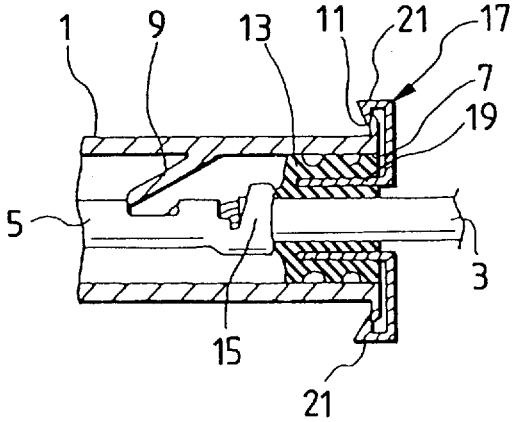
FIG. 6(a) PRIOR ART
FIG. 6(*a*) is a sectional view showing the conventional example.
Figure 6B:
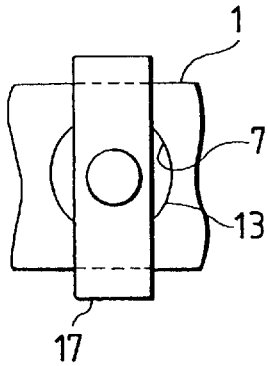
FIG. 6(b) PRIOR ART

Even in the case where the fixing engagement portions 41 are positionally displaced relative to the fixing lock portions 49 when the terminal 5 is inserted, the inclined guide portions 43 abut on the end portion 47*a*of the connecting portion 47 when the seal member 23 is pushed(see FIGS 3*b*and 3 *c*Then, if the seal member 23 is further pushed as it is, the inclined guide portions 43 are slid on the end portion 47*a*so that the seal member 23 is rotatably guided by means of the inclined surface of the guide portions 43 to thereby rotate relative to the terminal 5 and the cable 3. Only by such pushing of the seal member 23 into a predetermined position, it is possible to make the fixing engagement portions 41 positionally correspond to the fixing lock portions 49 by the rotation of the seal member 23 to thereby make the portions 41 and 49 engage with each other in the state without requiring any other operation.

Therefore, when the seal member 23 is to be fitted onto the cable 3 in advance as shown in FIG. 2, it is not necessary to consider the relative position between the fixing engagement portions 41 and the fixing lock portions 49, so that the attachment work can be performed easily. Even if the fixing engagement portions 41 do not positionally correspond to the fixing lock portions 49, it is possible to perform the attachment work very easily through the rotational guide by the relative sliding between the inclined guide portions 43 and the end portion 47*a*of the connecting portion 47. Further, when numbers of seal members 23 are to be carried as parts, a cylindrical portion 33 is formed so as to envelope each seal portion 25 so that not only the seal portions 25 can be prevented from being mutually entangled in the packed state or the like, but also the seal portions 25 can be prevented from being damaged by an external force. Furthermore, since the slide contact portion is constituted by the end portion 47*a*of the connecting portion 47 in this embodiment, it is not necessary to provide any special slide contact portion so that the structure is simplified.

Figure 4:
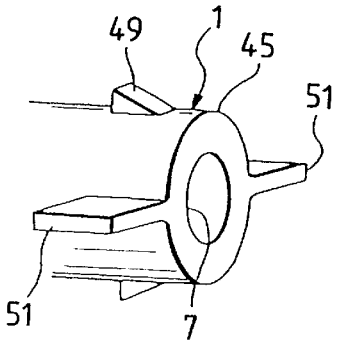
FIG. 4 is a perspective view showing a main portion of a housing according to another embodiment of the present invention.

FIG. 4 shows another embodiment of the present invention in which a main part of a housing 1 in the case where only one insertion opening 7 is provided is illustrated. In the housing 1, slide contact portions 51 are projected from an outer surface of a cavity 45 at its opposite sides. Therefore, also in this embodiment, a seal member can be guided by using the slide contact portions 51, so that it is possible to obtain the same functions and effects as those of the foregoing embodiment.

Further, the inclined guide portions may be provided on the housing 1 and the slide contact portion may be provided on the seal member 23.

According to the present invention, the seal member can be rotatably guided by relative sliding between the inclined guide portions and the slide contact portion. Therefore, when the seal member is to be fitted onto the cable in advance, it is not necessary to consider the relative positional relation between the fixing engagement portions and the fixing lock portions so that the attachment work can be performed easily. When the terminal is received and the seal member is attached into the insertion opening, positioning and assembling can be easily performed through such a guide as to rotate the seal member even if the positions of the fixing engagement portions and the fixing lock portions do not correspond to each other. Thus, the assembling work can be performed very easily.

What is claimed is:

1. A connector comprising:

a terminal to which a cable is clamped;

a housing including an insertion opening provided so as to receive said terminal inserted from said insertion opening, a terminal lock portion provided inside said housing for locking said inserted terminal, and a fixing lock portion provided outside said housing;

a seal member including a seal portion made of an elastic material and a fixing portion which is harder than said seal portion, an inner surface of said seal portion being tightly fitted onto the cable so as to be rotatable relatively to the cable, an outer surface of said seal portion being tightly fitted onto an inner surface of said insertion opening upon insertion of said seal member into said insertion opening of said housing, and said fixing portion having a fixing engagement portion which is to be locked on said fixing lock portion;

an inclined guide portion provided in one of said housing or said fixing portion of said seal member; and means for slidably engaging said housing with respect to said fixing portion, provided on the other of said housing or said fixing portion so as to be slidable relative to said inclined guide portion, wherein said inclined guide portion and said slidable engaging means guide said seal member so as to make said seal member rotate into a position where said fixing engagement portion engages with said fixing lock portion when said seal member is to be attached into said insertion opening.

2. The connector according to claim 1, wherein said inclined guide portion is provided on said fixing portion and said slidable engaging means is provided on said housing.

3. The connector according to claim 2, wherein said fixing portion has a cylindrical portion which is fitted onto an outer surface of said housing at a side of said insertion opening, said fixing engagement portion being provided on a front end of said cylindrical portion, said inclined guide portion being provided on said cylindrical portion so as to be inclined from a front end to a rear end of said cylindrical portion, and wherein said fixing lock portion is provided on the outer surface of said housing at the side of said insertion opening, said slidable engaging means being provided on the outer surface of said housing at the side of said insertion opening.

4. The connector according to claim 3, wherein said housing further includes multiple cylindrical cavity portions, wherein said slidable engaging means forms a connecting portion for integrally connecting said multiple cylindrical cavity portions each of said multiple cylindrical cavity portions having said insertion opening.

* * * * *